United States Patent [19]

Krieger et al.

[11] 4,297,828

[45] Nov. 3, 1981

[54] AUTOMATED LIQUID CONTAINER FILLING APPARATUS

[76] Inventors: Aaron J. Krieger, 2430 Harn Blvd; Lawrence E. Elsie, 1573 Carroll St., both of Clearwater, Fla. 33516

[21] Appl. No.: 43,125

[22] Filed: May 29, 1979

[51] Int. Cl.[3] ..... B65B 3/02; B65B 7/28

[52] U.S. Cl. ..... 53/282; 53/276; 53/300; 53/307

[58] Field of Search ..... 53/282, 283, 307, 276, 53/272, 308, 306, 300

[56] References Cited

U.S. PATENT DOCUMENTS

| | | | |
|---|---|---|---|
| 2,969,632 | 1/1961 | Carew et al. | 53/283 |
| 2,972,216 | 2/1961 | Schmidt | 53/307 X |
| 3,509,682 | 5/1970 | Logemann | 53/307 X |

*Primary Examiner*—James F. Coan

[57] ABSTRACT

An automated liquid container filling apparatus is disclosed which automatically fills cups with a fluid and then seals the cups with covers. The apparatus includes a circular table which is rotatably mounted on a base member for rotation about an axis perpendicular to the base member, having a plurality of holes therethrough spaced at equal angles about the circumference of the table. A motor is mounted to the base member and is operatively connected to the table for periodically rotating the table through the angle. A cup dispenser is mounted on the base member at a first position over the table, having a plurality of cups stored in a storage portion and a cup delivery mechanism adjacent to the cup storage portion which is operatively connected to the motor, for periodically dispensing one of the plurality of cups into each of the holes in the table, in synchronism with the periodic table rotation. A filling station is mounted on the base member at a second position over the table, having a fluid reservoir storing a fluid to be dispensed into the cups and a fluid delivery mechanism connected to the reservoir, which is operatively connected to the motor for periodically dispensing a predetermined volume of the fluid through a delivery nozzle connected therewith, into each of the cups in the holes in the table, in synchronism with the periodic table rotation. A cover dispenser is mounted on the base member at a third position over the table, having a plurality of cup covers stored in a cover storage portion and a vacuum picking nozzle adjacent to the cover storage portion which is operatively connected to the motor for periodically picking one of the plurality of covers and placing it over the mouth of each one of the cups filled with fluid in the holes in the table in synchronism with the periodic table rotation. A heat sealing station is mounted on the base member at a fourth position of the table, having a heating element which is operatively connected to a motor for periodically heating the cover placed over the mouth of each one of the cups filled with the fluid in the holes in the table, to heat seal the cover to the cup in synchronism with the periodic table rotation. A cup removal station is mounted on the base member at a fifth position adjacent to the table, having an elevator which is operatively connected to the motor, for periodically raising the heat sealed cup from the level of the table to the level of a removal ramp. The removal station also has a rake which is operatively connected to the motor, for periodically pushing the raised, heat sealed cup onto the removal ramp in synchronism with the periodic table rotation. The resulting automated liquid container filling apparatus automatically fills cups with fluid and seals the covers in a more sanitary and efficient manner than has been available in the prior art.

6 Claims, 28 Drawing Figures

FIG. 1
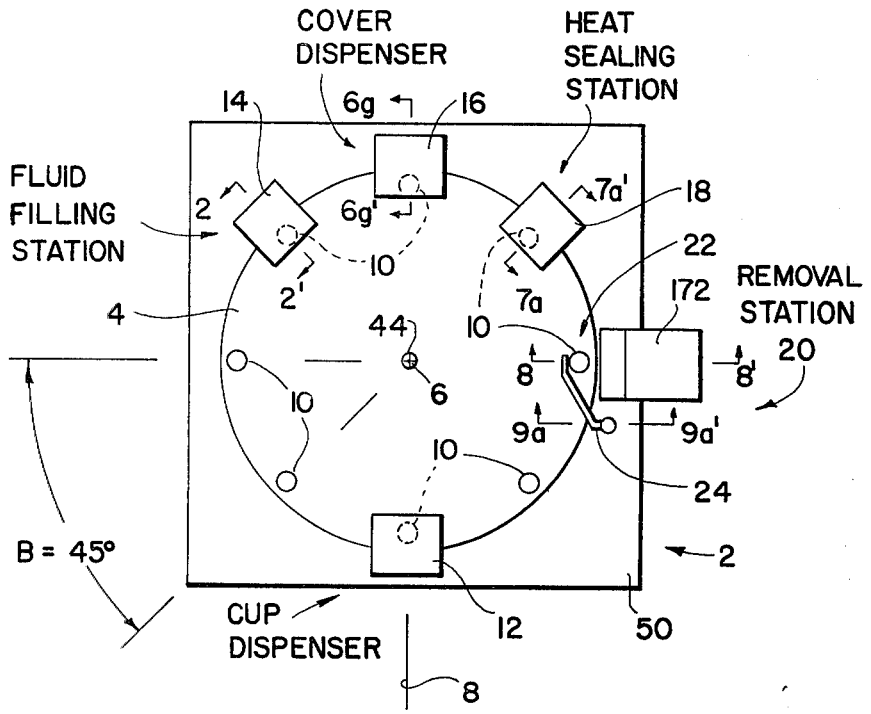
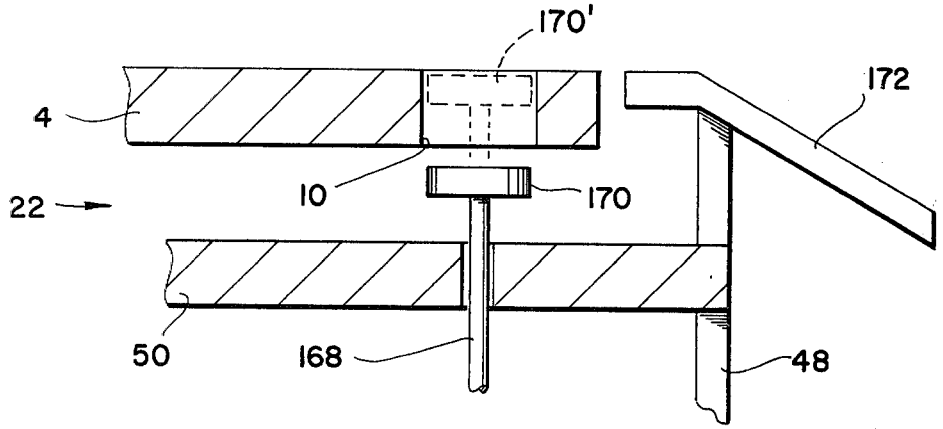
FIG. 8
SEC. 8-8'

SEC. 2 - 2'

SEC. 4 - 4'

153
154
290
155
294
300
288
132
296
298
292
140

153
154
288
140
155
294
300
132
290
296
298
292

132
153
292
154
155
140
294
288
300
286
290
296
298
16

158
302
156
132

158
302
304
302
156

SEC. 5-5'
50
133
277
92
276
212
277
88
278
137
280
282
18
284

SEC. 6b-6b'

SEC. 6e-6e'

FIG. 6g
SEC. 6g - 6g'
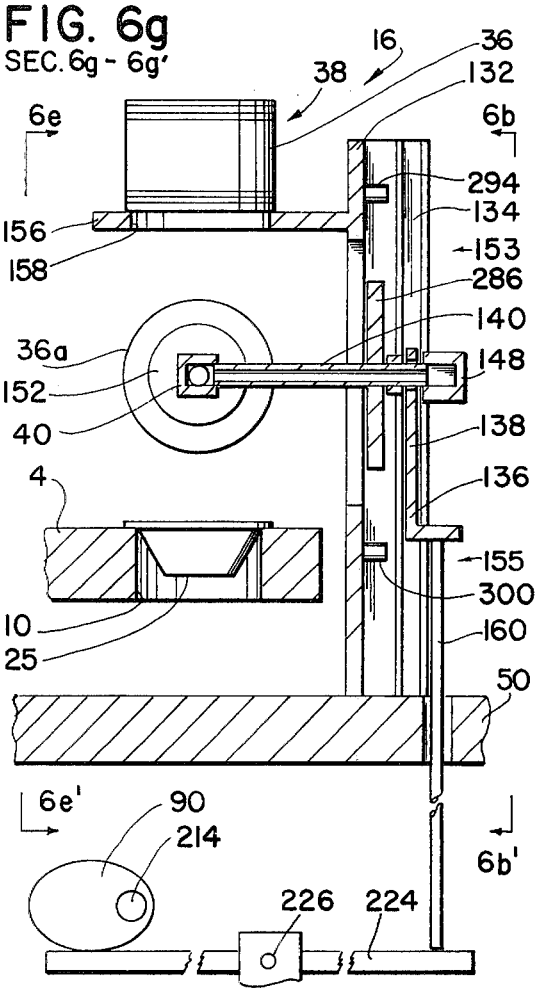
FIG. 7a
SEC. 7a - 7a'
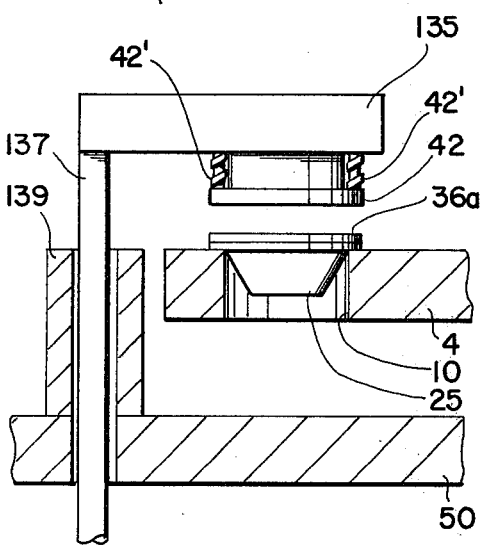
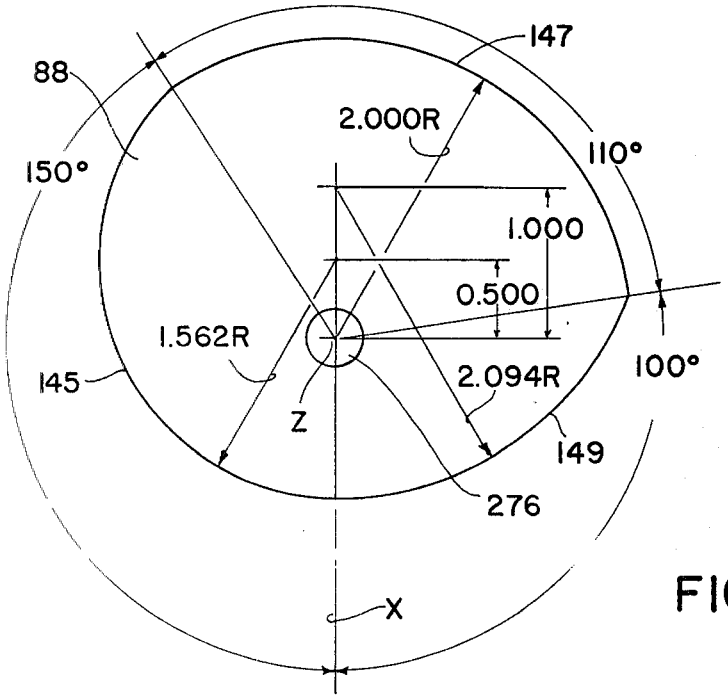
FIG. 7b FIG. 9a
SEC. 9a-9a'
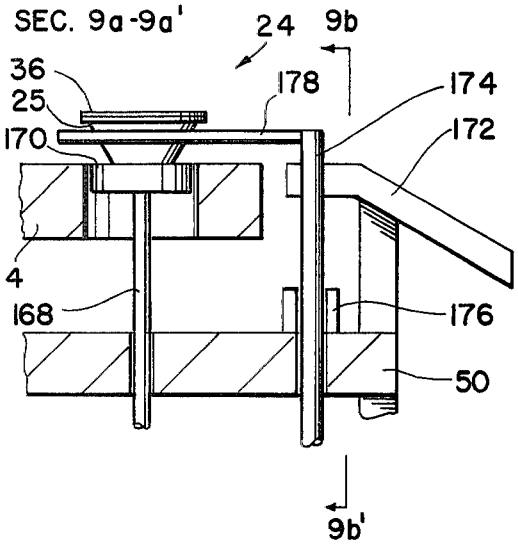
FIG. 9b
SEC. 9b-9b'
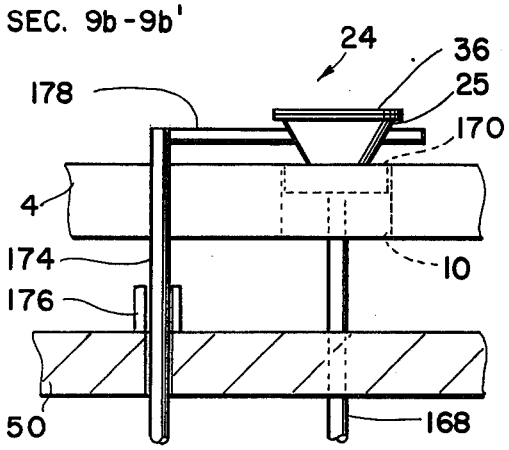
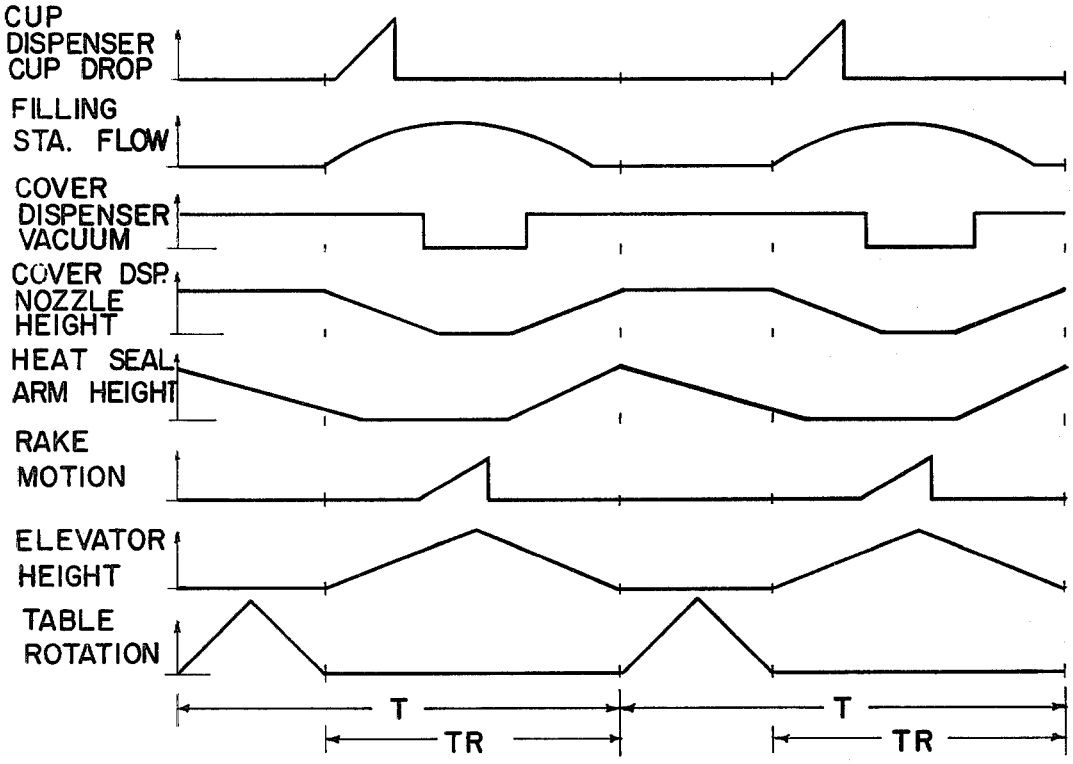
FIG. 10

SEC. 12-12'

SEC. 13-13'

SEC. 14b-14b'

AUTOMATED LIQUID CONTAINER FILLING APPARATUS

FIELD OF THE INVENTION

The invention disclosed broadly relates to automated article handling apparatus and more particularly relates to automatic container handling and filling apparatus.

BACKGROUND OF THE INVENTION

Mechanization, the substitution of mechanical power for that of men or animals, can be traced back to antiquity. The handling of material provides many examples of the way in which man has sought to lighten his labors by employing mechanical devices, for example in building, in mining, and in raising water. The mechanization of processes, on the other hand, did not become wide spread until the beginning of the Industrial Revolution in the 18th century with the invention of the cotton gin. The term "automation" has been defined as the technology of automatic working in which the handling methods, the processes, and the design of the processed material are integrated to utilize the mechanization of thought and effort in order to achieve an automatic chain of processes. The use of men within this definition is not precluded, but becomes a part of the overall objective of reducing the number of persons whose effort is required to produce the particular result.

In the food processing and handling industry, automation has created a high standard of cleanliness and productivity for the products produced thereby. Industry sectors such as biscuit and cookie manufacturers, have taken great strides in introducing automatic mixers and ovens to handle and process their food products.

However, one sector of the food handling and processing industry which has not been adequately automated is that of filling of fruit and other juices into plastic containers and then sealing the containers. A substantial amount of hand labor has been engaged in by this sector of the food handling industry, leading to a higher risk of contaimination and a relatively low productivity.

OBJECTS OF THE INVENTION

It is therefore an object of the invention to improve the standard of cleanliness for the filling and sealing of plastic containers of fruit or other juices.

It is still another object of the invention to improve the productivity of the operations of filling and sealing plastic containers of fruit or other juices.

It is a further object of the invention to automatically dispense predetermined volumes of fluid in an improved manner.

It is still another object of the invention to automatically place caps onto cups in a conveyor in an improved manner.

It is yet another object of the invention to automatically seal caps onto cups in a conveyor in an improved manner.

SUMMARY OF THE INVENTION

These and other objects, features and advantages of the invention are accomplished by the automated liquid container filling apparatus disclosed herein. An automated liquid container filling apparatus is disclosed which automatically fills cups with a fluid and then seals the cups with covers. The apparatus includes a circular table which is rotatably mounted on a base member for rotation about an axis perpendicular to the base member, having a plurality of holes there through spaced at equal angles about the circumference of the table. A motor is mounted to the base member and is operatively connected to the table for periodically rotating the table through the angle. A cup dispenser is mounted on the base member at a first position over the table, having a plurality of cups stored in a storage portion and a cup delivery mechanism adjacent to the cup storage portion which is operatively connected to the motor, for periodically dispensing one of the plurality of cups into each of the holes in the table, in synchronism with the periodic table rotation. A filling station is mounted on the base member at a second position over the table, having a fluid reservoir storing a fluid to be dispensed into the cups and a fluid delivery mechanism connected to the reservoir, which is operatively connected to the motor for periodically dispensing a predetermined volume of the fluid through a delivery nozzle connected therewith, into each of the cups in the holes in the table, in synchronism with the periodic table rotation. A cover dispenser is mounted on the base member at a third position over the table, having a plurality of cup covers stored in a cover storage portion and a vacuum picking nozzle adjacent to the cover storage portion which is operatively connected to the motor for periodically picking one of the plurality of covers and placing it over the mouth of each one of the cups filled with fluid in the holes in the table, in synchronism with the periodic table rotation. A heat sealing station is mounted on the base member at a fourth position of the table, having a heating element which is operatively connected to the motor for periodically heating the cover placed over the mouth of each one of the cups filled with the fluid in the holes in the table, to heat seal the cover to the cup in synchronism with the periodic table rotation. A cup removal station is mounted on the base member at a fifth position adjacent to the table, having an elevator which is operatively connected to the motor, for periodically raising the heat sealed cup from the level of the table to the level of a removal ramp. The removal station also has a rake which is operatively connected to the motor, for periodically pushing the raised, heat sealed cup onto the removal ramp in synchronism with the periodic table rotation. The resulting automated liquid container filling apparatus automatically fills cups with fluid and seals the covers in a more sanitary and efficient manner than has been available in the prior art. The fluid delivery mechanism, the cover dispenser and the heat sealing station are significant, inventive features in their own right.

DESCRIPTION OF THE FIGURES

These and other objects, features and advantages of the invention will be more fully appreciated with reference to the accompanying figures.

FIG. 1 is a top overall view of the automated liquid container filling apparatus invention with the table 4 at rest.

FIG. 2 is a cross-sectional view along section line 2—2' of FIG. 1. FIG. 4 is a cross-sectional view along section line 4—4' of FIG. 2. FIG. 3 is a cross-sectional view along section line 3—3' of FIG. 4.

FIGS. 6a–6g show the cover dispenser 16. FIG. 6g is a cross-sectional view along section line 6g—6g' of FIG. 1. FIG. 6b is a cross-sectional view along section line 6b—6b' of FIG. 6g. FIG. 6e is a cross-sectional view along section line 6e—6e' of FIG. 6g.

FIGS. 7a and 7b show the heat sealing station 18. FIG. 7a is a cross-sectional view along section line 7a—7a' of FIG. 1.

FIG. 8 shows the elevator 22 of the cup removal station 20. FIG. 8 is a cross-sectional view along line 8—8' of FIG. 1.

FIGS. 9a and 9b show the rake 24 for the cup removal station 20. FIG. 9a is a cross-sectional view along section line 9a—9a' of FIG. 1. FIG. 9b is a cross-sectional view along section line 9b—9b' of FIG. 9a.

FIG. 10 shows a timing diagram for the overall operation of the automated liquid container filling apparatus.

DISCUSSION OF THE PREFERRED EMBODIMENT

Figure 11:
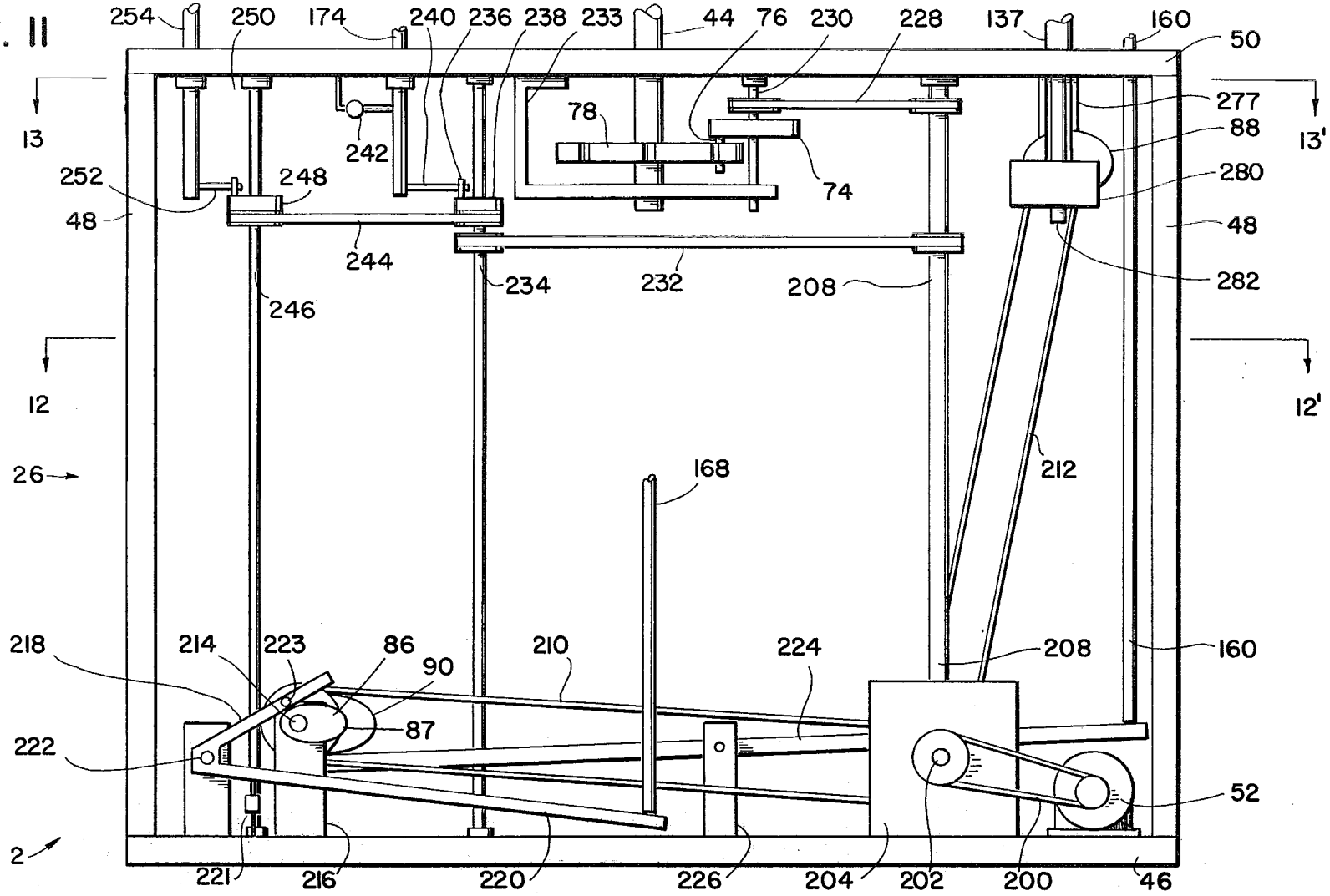
FIG. 11 is a side view of drive means 26 of the automated liquid container filling apparatus.

The automatic container filling apparatus shown in FIG. 1 and FIG. 11 includes a circular table 4 which is rotatably mounted on the vertical shaft 44 to the base member 2 which includes the lower base plate 46, the four corner vertical supports 48, and the upper base plate 50. The table 4 is mounted for rotation about an axis 6 which is perpendicular to the base member 2, having a plurality of holes 10 therethrough. In the embodiment disclosed, there are eight holes in the table 4. It is understood, however, that any reasonable number of holes 10 can be employed in the table 4. The holes 10 are spaced at equal angles B about the circumference of the table 4. In the embodiment illustrated, the angle B is 45°.

A drive means 26, shown to better advantage in FIG. 11, is mounted to the base member 2 and is operatively connected to the table 4 in FIG. 1 for periodically rotating the table 4 at periods of time T, through the angle B.

Figure 14A:
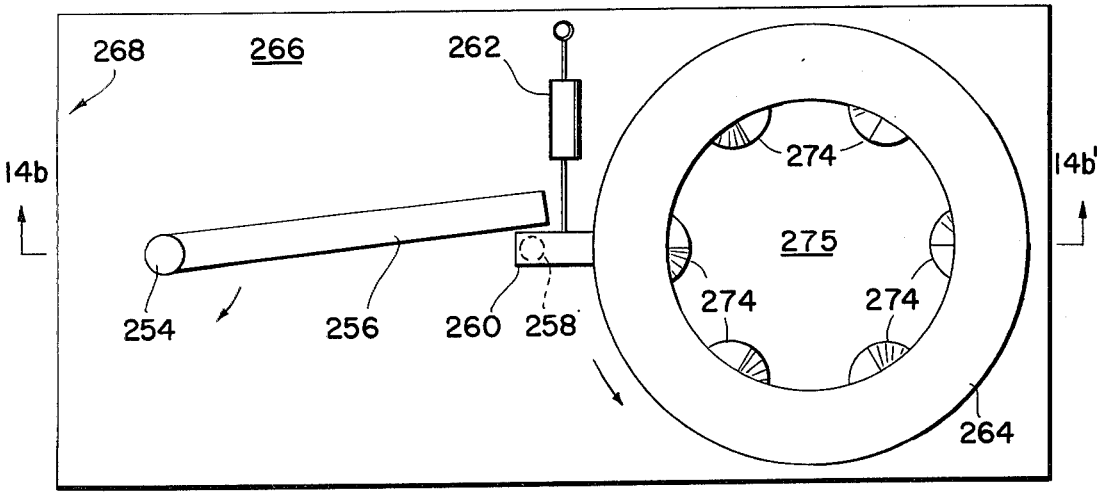
FIG. 14a shows a top view of the cup dispenser 12.
Figure 14B:
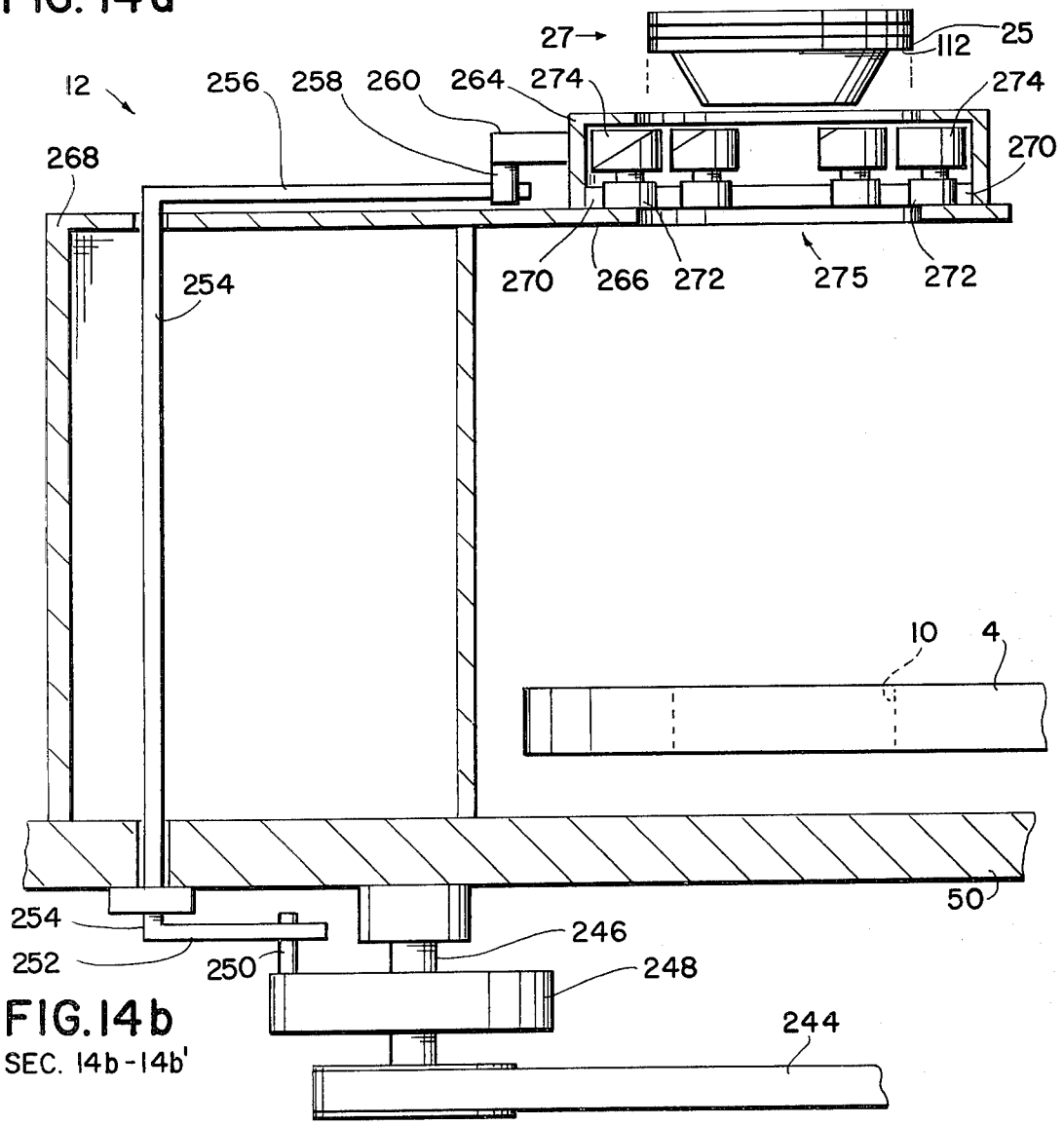
FIG. 14b shows a side, cross-sectional view along section line 14b—14b' of FIG. 14a, of the cup dispenser 12.

A cup dispenser 12 is mounted on the base member 2 as is shown to better advantage in FIGS. 14a and 14b. The cup dispenser 12 is mounted at a first position over the table 4. The cup dispenser 12 has a plurality of cups 25 stored in a storage portion 27. A cup delivery mechanism 264 in the cup dispenser 12 in FIG. 14a is located adjacent to the cup storage portion 27. The cup delivery mechanism 264 is operatively connected to the drive means 26 of FIG. 11, for periodically dispensing one of the plurality of cups 25 into each of the holes 10 in the table 4, in synchronism with the periodic rotation of the table.

Figure 2:
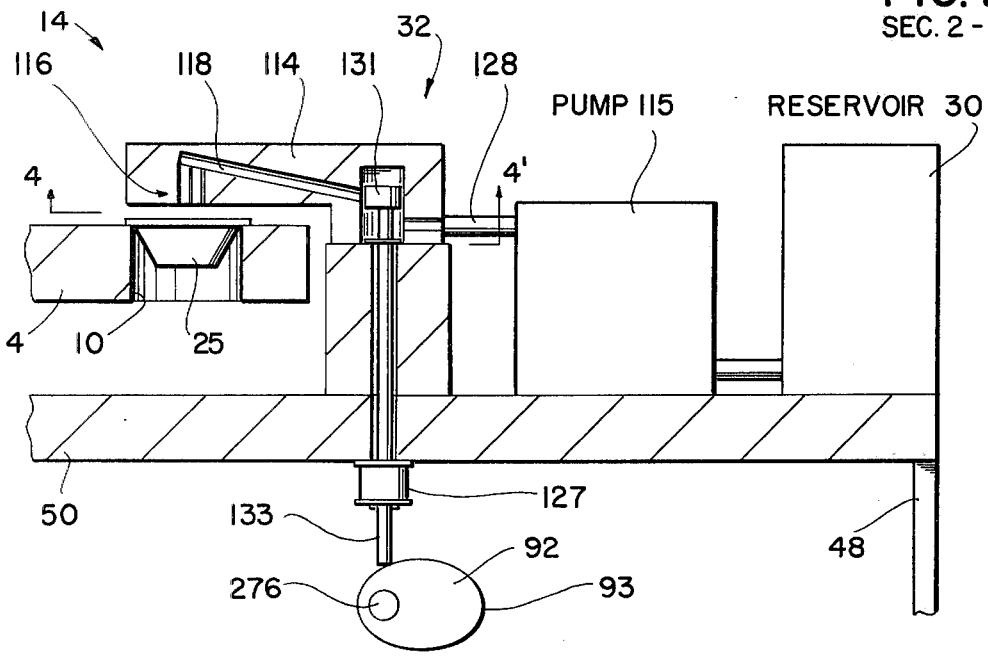
FIGS. 2, 3 and 4 show the filling station 14.
Figure 3:
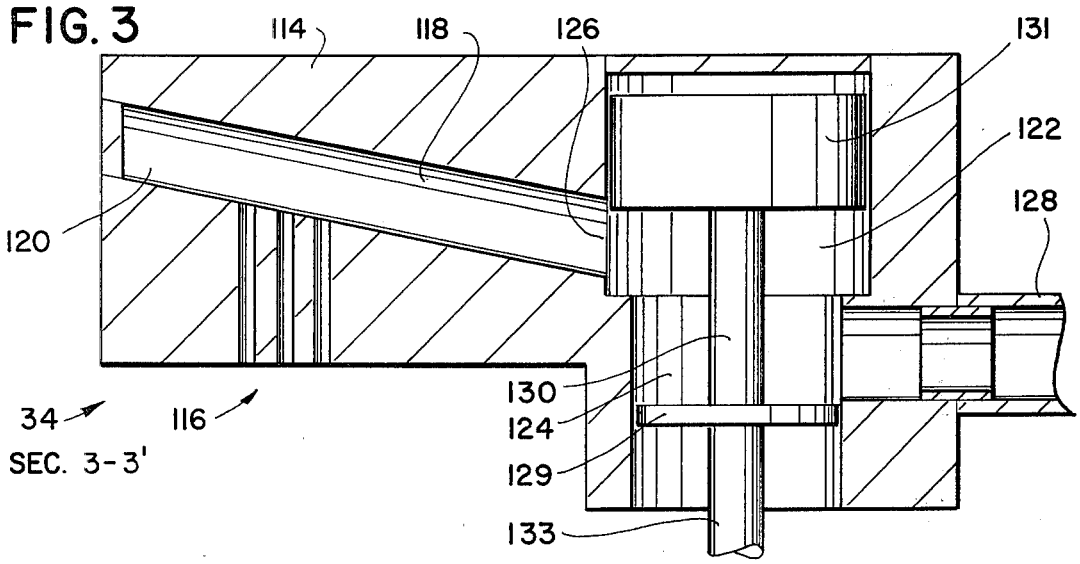
Figure 4:
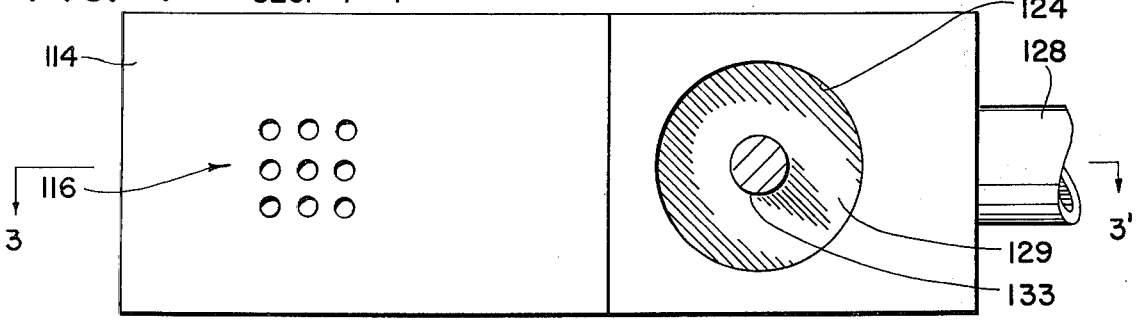

A filling station 14 of FIG. 1, shown to better advantage in FIGS. 2, 3 and 4, is mounted on the base member 2 of FIG. 11 at a second position over the table 4. The filling station 14 has a fluid reservoir 30 which stores a fluid such as fruit juice or other consumable liquid, to be dispensed into the cups 25. The filling station 14 also includes a fluid delivery mechanism 32 which is connected to the reservoir 30 and is operatively connected to the drive means 26 of FIG. 11, for periodically dispensing a predetermined volume of the fluid through a delivery nozzle 34 connected therewith, into each of the cups 25 in the holes 10 in the table 4, in synchronism with the periodic table rotation.

In a semi-automatic embodiment, the cups 25 could be hand-fed onto the table 4, thereby eliminating the cup dispenser 12.

The cover dispenser 16, which is shown to better advantage in FIGS. 6a–6g and FIGS. 15a–15e, is mounted on the base member 2 at a third position over the table 4. The cover dispenser 16 has a plurality of cup covers 36 stored in a cover storage portion 38. The cover dispenser 16 also includes a vacuum picking nozzle 40 which is adjacent to the cover storage portion 38, which is operatively connected to the drive means 26 of FIG. 11, for periodically picking one of the plurality of covers 36 and placing it over the mouth of each one of the cups 25 filled with fluid in the holes 10 in the table 4, in synchronism with periodic table rotation.

A heating sealing station 18, which is shown to better advantage in FIGS. 7a and 7b, is mounted on the base member 2 at a fourth position over the table 4. The heat sealing station 18 has a heated element 42 which is operatively connected to the drive means 26 of FIG. 11, shown in greater detail in FIG. 5, for periodically heating the cover 36 placed over the mouth of each one of the cups 25 filled with the fluid in the holes 10 in the table 4, to heat seal the covers 36 to the cup 25, in synchronism with the periodic table rotation.

A cup removal station 20 has an elevator 168, which is shown to better advantage in FIG. 8, and a rake mechanism 24, which is shown to better advantage in FIGS. 9a and 9b. The cup removal station 20 is mounted on the base member 2 of FIG. 1 at a fifth position adjacent to the table 4. The elevator 168 is operatively connected to the drive means 26 of FIG. 11, for periodically raising the heat sealed cup 25 from the level of the table 4 to the level of a removal ramp 172. The rake 24 is operatively connected to the drive means 26 of FIG. 11, for periodically pushing the raised, heat sealed cup 25 onto the removal ramp 172. The operation of the elevator 168 and the rake mechanism 24 is in synchronism with a periodic table rotation. The resulting automatic container filling apparatus fills the cups 25 automatically and caps them with the covers 36 automatically, in a more efficient and sanitary manner than has been available in the prior art.

As is shown in FIG. 1, the relative position of the stations with respect to the axis 8 is that the cup dispenser 12 is at 0°, the filling station 14 is at 135°, the cover dispenser 16 is at 180°, the heat sealing station 18 is at 225°, and the cup removal station 20 is at 270°. It is appreciated that other relative positions for these stations could be adopted, however their locations must be at integral multiples of the angle B which, for the embodiment illustrated, are integral multiples of 45°. The direction of motion for the table 4 about the axis 6 is shown as clockwise in FIG. 1 so that a given hole 10 in the table 4 will pass from the cup dispenser 12 to the filling station 14, then to the cover dispenser 16, and then to the heat sealing station 18, followed by the cup removal station 20. It is this configuration and the configuration of the drive means 26 of FIG. 11 that makes this automatic container filling apparatus unique. The motor 52 of FIG. 11 provides the rotary power for the automated liquid container filling apparatus.

Figure 13:
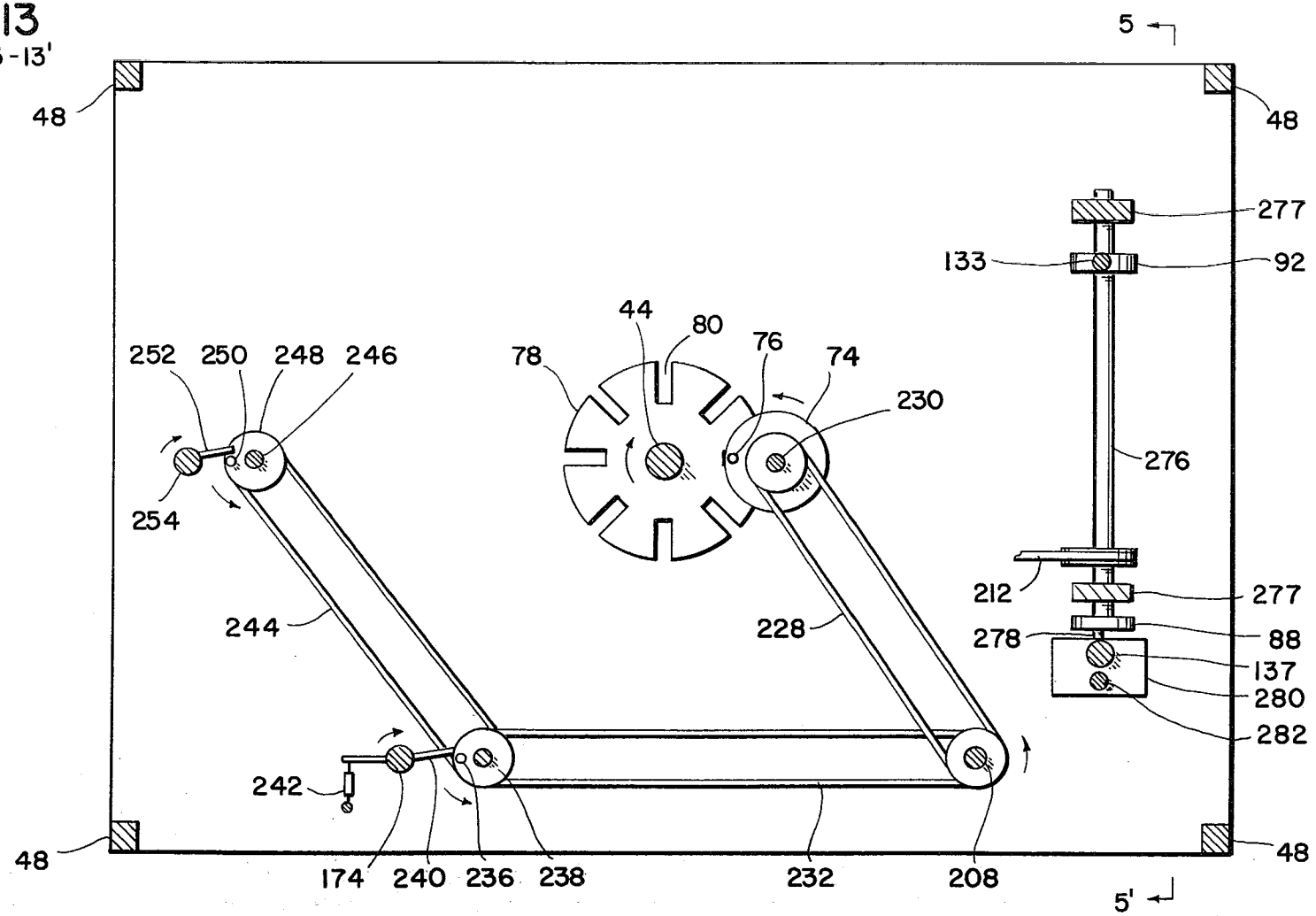
FIG. 13 is a cross-sectional view along the section line 13—13' of FIG. 11, showing an upper portion of the drive means 26.

A Geneva driving wheel 74, having a driving lug 76 mounted thereon, is driven by the vertical shaft 208 mounted to the miter gear 204, as shown in FIG. 11 and FIG. 13.

A Geneva indexing wheel 78 is mounted on the shaft 44. The Geneva indexing wheel 78 has a plurality of N radial grooves 80 which, in the embodiment shown is eight grooves, in the circumference of the wheel 78. The number of grooves 80 is equal to the number of the plurality of holes 10 in the table 4. The radial grooves 80 operatively engage the Geneva driving wheel lug 76 and, since the Geneva indexing wheel 78 is connected to the table 4 by means of the shaft 44, the table undergoes a periodic rotation having a period T between rest periods of duration TR, through an angle of 360° divided by N or 45° in the embodiment shown. FIG. 10 is a timing diagram showing the relative durations T and TR for the table rotation. The intermittent drive has a 225° dwell period TR and a 135° index period for each of the eight positions of the table. The duration of the dwell and index periods is determined by the speed of the motor 52.

Figure 12:
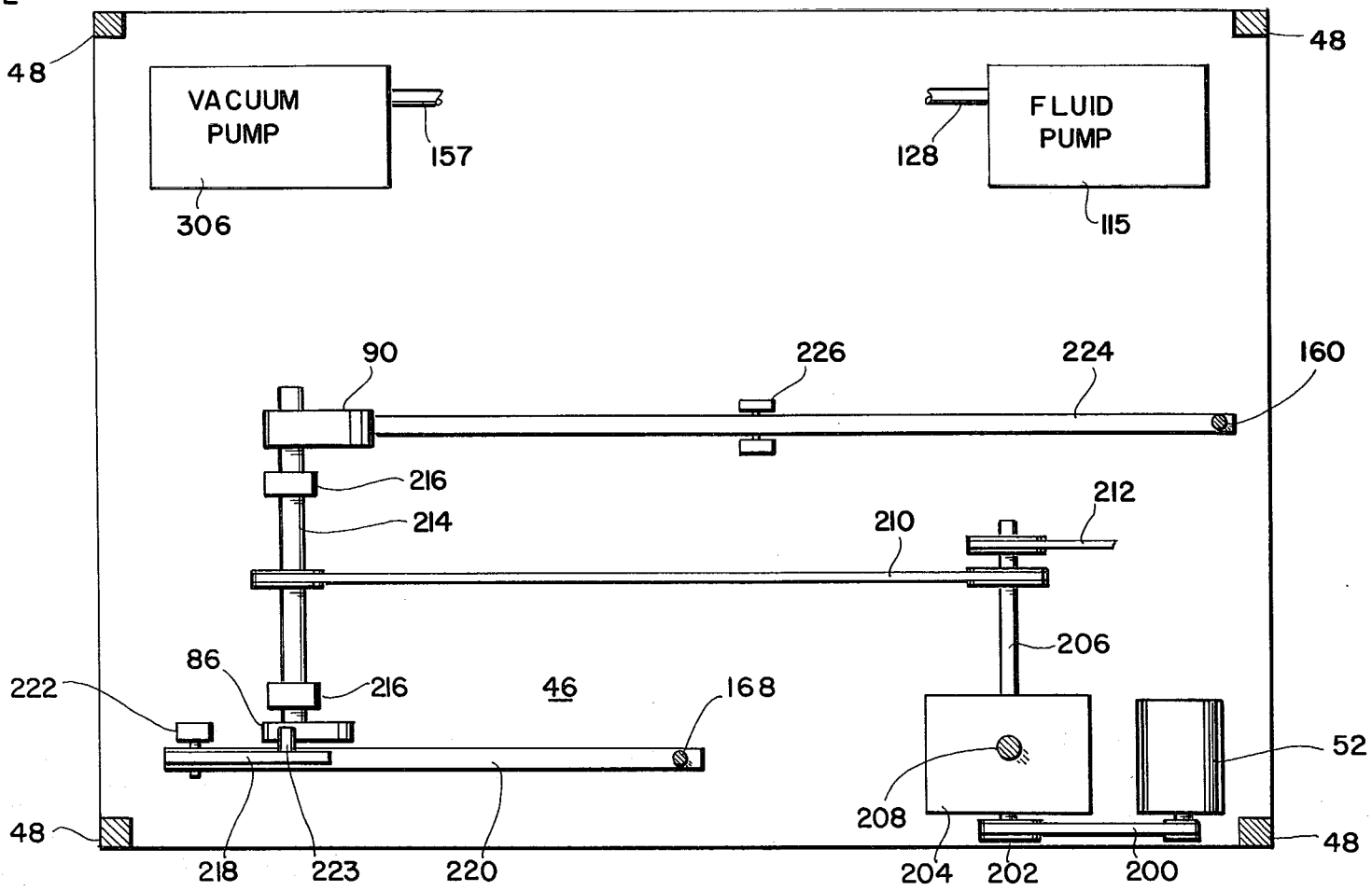
FIG. 12 is a cross-sectional view along the section line 12—12' of FIG. 11, showing a lower portion of the drive means 26.

The drive motor 52 of FIG. 11, is connected by means of the roller chain 200 to the input shaft 202 of the miter gear assembly 204 which converts the relatively high rotational speed of the drive motor 52 to the relatively lower rotational speed of the horizontal output shaft 206 and the vertical output shaft 208. Shafts 206 and 208 rotate at identical speeds. The horizontal output shaft 206 drives the roller chain 210 which, in turn, drives the shaft 214 at the same speed as shaft 206, and drives the roller chain 212 which, in turn, drives the shaft 276 at the same speed as shaft 206. The shaft 214, mounted by means of the blocks 216 to the base 46, provides the motive power for the elevator push rod 168 and the cover dispenser push rod 160. The shaft 214 drives the cam 86 which, in turn, drives the cam follower 223 on lever 218 which pivots about the pivot 222 and alternately lifts and lowers the elevator lever 220 connected therewith. Tension spring 221 connected to the lever 220 keeps the cam follower 223 in constant contact with the cam 86. The lever 220 alternately lifts and lowers the elevator push rod 168. The shaft 214 also rotates the cam 90 which periodically pivots the lever 224 about the pivot 226 so as to alternately lift and lower the push rod 160 for the cover dispenser 16. As can be seen in FIG. 12, room is available on the surface of the base member 46 for the fluid pump 115 which is connected to the pipe 128 and for a vacuum pump 306 which is connected to the vacuum line 157.

Figures 5, 15A, 15B, 15C, 15D, 15E:
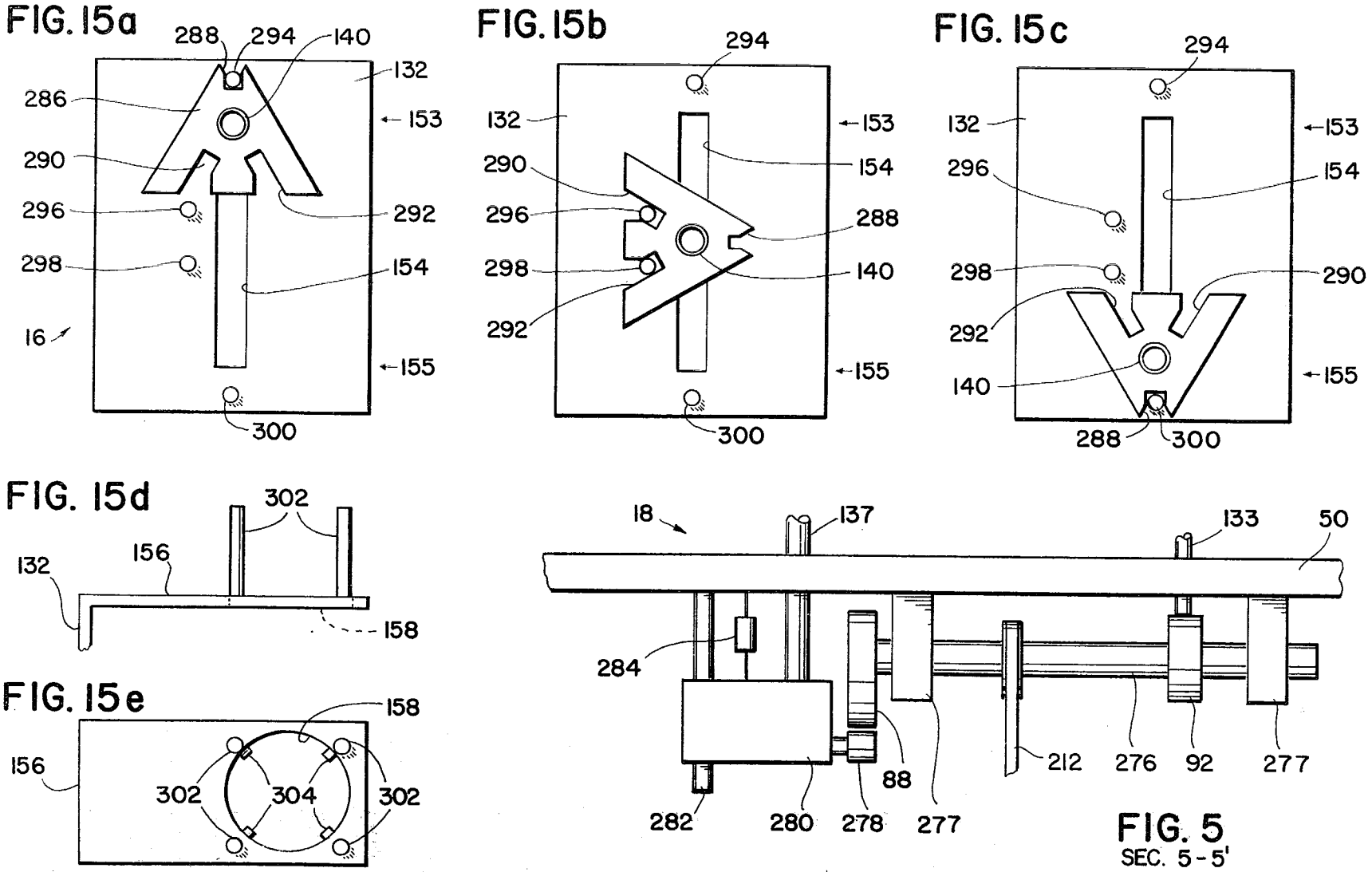
FIG. 5 is a cross-sectional view along line 5—5' of FIG. 13 showing a portion of the drive means for the filling station 14.
FIGS. 15a–15c show a sequence of breakaway, rear views of the cover dispenser 16 featuring the nozzle rotating cam 286. The sequence for FIGS. 15a–15c corresponds to that for FIGS. 6a–16c, respectively.
FIGS. 15d and 15e show two views of the cover storage portion of the cover dispenser 16.

The horizontal output shaft 206 of the miter gear assembly 204 drives the roller chain 212 which, in turn, drives the shaft 276 for the portion of the driving means 26 which drives the fluid filling station 14 and the heat sealing station 18, as shown to better advantage in FIG. 5. Shaft 276 rotates at the same speed as shaft 206. The cam 92 is mounted on the shaft 276 and drives the push rod 133 at the fluid filling station 14. The shaft 276, which is mounted by means of the blocks 277 to the plate 50, has the cam 88 mounted thereon, which drives the push rod 137 for the heat sealing station by means of engagement with the cam follower 278. The cam follower 278 is mounted on the stabilizing block 280 which, in turn, is rigidly connected to the push rod 137. The push rod 137 is biased in an upward direction by means of the tension spring 284. The stabilizing block 280 is maintained in vertical alignment by means of its sliding engagement with the alignment shaft 282 which is rigidly mounted to the plate 50.

The vertical output shaft 208 of the miter gear assembly 204 drives a first roller chain 228 which rotates the shaft 230 upon which is mounted a Geneva driving wheel 74. Shaft 230 rotates at the same speed as shaft 208. The Geneva driving wheel 74 then intermittently drives the Geneva indexing wheel 78 which, thereby, intermittently rotates the table 4 connected to shaft 44 as discussed above. The support member 233 serves to maintain the table shaft 44 and shaft 230 in proper alignment.

The vertical output shaft 208 also drives the roller chain 232 which rotates a rotary actuator 238 at the same rate of rotation as the shaft 208. The rotary actuator 238 is mounted on the shaft 234 and has a cam follower 236 which intermittently contacts the lever 240 connected to the vertical shaft 174 driving the rake 24. The lever 240 is biased against the lobe 236 by means of the tension spring 242. The shaft 234 also drives the roller chain 244 which rotates the rotary actuator 248 at the cup dispenser station 12, at the same speed as rotary actuator 238.

FIG. 14*a* shows a top view of the cup dispenser 12. FIG. 14*b* shows a side, cross-sectional view along the section line 14*b*—14*b*′ of FIG. 14*a*. The cup delivery mechanism includes a ring gear or cam 270 which is operatively connected to the shaft 246 as follows. The ring gear 270 is mounted to the inside surface of an annular housing 264 having an actuating arm 260 mounted thereon. The annular housing rotates about a central axis and is rotatably mounted to the plate 266, coaxially with the hole 275 through which the cups 25 drop from the cup storage portion above the housing 264. The pin 258 mounted to the arm 260 is contacted by the lever 256 which is mounted to the shaft 254. The shaft 254, in turn, is driven by the lever 252 which is intermittently contacted by the cam follower 250 on the rotary actuator 248 which is rotatably mounted to shaft 246. The ring gear 270 will thereby undergo an incremental rotation which is timed to occur during the rest period for the table 4. Helical escapement wheels 274, which are rotatably mounted on the plate 266, are rotatably driven by virtue of their associated gears 272 which mesh with the ring gear 270. The six helical escapement wheels 274 located beneath the cup storage portion, engage the lip 112 of the lowest cup 25 in the stack of cups in the cup storage portion, and advance that lowest cup downwardly as the helical wheels 274 rotate in response to the actuation by the cam follower 250 on the rotary actuator 248. In this manner, the lowest cup 25 is dropped from a ready position, through the hole 275 and into a hole 10 in the table 4 which is aligned therewith. Timing for this operation may be seen in the timing diagram of FIG. 10. The housing 268 shown in FIG. 14*b* supports the plate 266 above the hole 10 and in the table 4.

FIGS. 2, 3 and 4 show the detailed structure of the filling station 14. The filling station 14 includes the fluid delivery mechanism 32 which has the rotary cam 92 operatively connected to the motor 52 by means of the shaft 276. The rotary cam 92 rotates at a constant angular velocity having a period T and has an actuating orientation 93 which is timed to occur during the rest period TR for the table 4.

A valve shown in FIG. 3 has the head portion 131, the stem portion 130, the bottom portion 129, which is connected by means of the push rod 133 to the cam 92. Compression spring 127 maintains push rod 133 in contact with cam 92. The valve 131 is located in the fluid flow path which includes the reservoir 30 connected by means of the pipe 128 to the fluid inlet chamber 124 and 122. The valve 131 passes fluid from the reservoir 30 through the nozzle 34 and into one of the cups 25 in one of the table holes 10 aligned with the filling station 14 when the cam 92 is oriented in the actuating position 93.

The nozzle 34, which is shown in more detail in FIG. 3 and FIG. 4, has a fluid inlet chamber 122 and 124 connected to the reservoir 30, having an exit port 126, within which the valve 131 selectively blocks the exit port 126. A delivery channel 118 connected to the exit port 126, is oriented upwardly at an angle of approximately 15° with respect to the horizontal from the exit port 126. The delivery port 116, consisting of a plurality of holes, opens into the delivery channel 118 at the upper end 120 thereof, and is positioned over one of the table holes 10 aligned with the filling station 14. The upper end 120 of channel 118 is otherwise closed. In this manner, the dripping of fluid from the delivery port 116 is prevented by the upward angular orientation of the delivery channel 118, when the valve 131 blocks the exit port 126. The plurality of holes 116 reduces the incidence of splashing fluid in the cup 25 and yet provide a sufficient flow rate for rapid filling. Different quantities of fluid delivered and different flow rates can be achieved by adjusting the speed of rotation of cam 92, the rate of delivery of the fluid by the pump 115, or the length of the push rod 133.

The cover dispenser 16 is shown in more detail in the FIGS. *6a–6g*. A series of break-away views in FIGS. *15a–15c*, show the detailed operation of the nozzle rotating cam 286. FIGS. *15a–15c* correspond to FIGS. *6a–6c*, respectively. The cover dispenser 16 includes a fixed vertical plate 132 mounted on the base plate 50 and located beneath the storage portion 38. The fixed vertical plate 132 supports the supply of covers 36 on the horizontal platform 156 attached to the base plate 132.

FIGS. *15d* and *15e* show two views of the cover storage portion 38 of the cover dispenser 16. It is seen in FIG. *15d* that vertical stabilizing posts 302 are mounted on the horizontal plate 156 around the hole 158 so as to stabilize the stack of covers 36 in the cover storage portion 38. As may be seen in FIG. *15e*, since the hole 158 is slightly larger in diameter than the diameter of the covers 36, small finger extensions 304 protrude out from the edge of the hole 158 so as to engage the covers 36 in the cover storage portion 38 and prevent them from inadvertently falling through the hole 158.

Movable plate 136 having an upward extension 138, is slidably mounted in the slots 134 of the fixed plate 132. The movable plate 136 assumes an upward position 153 or a downward position 155 by sliding in the groove 134. The movable plate 136 is operatively connected by means of the push rod 160 to the lever 224 of FIG. 12. The lever 224 of FIG. 12 pivots on the fulcrum 226 so as to always be in contact with the operating surface of the cam 90. Thus, the movable plate 136 is operatively connected to the rotary cam 90 so as to undergo vertical motion from the upward position 153 to the downward position 155 and then back to the upward position 153 when the cam 90 moves through its actuating orientation. The rotary cam 90 of FIG. 12 is operatively connected by means of the shaft 214 to the motor 52 and rotates at a constant angular velocity having a period T. The rotary cam 90 has an actuating orientation which is timed to occur during the rest period TR for the table 4.

The upper stop pin 294 and the lower stop pin 300 are mounted on the fixed vertical plate 132 along the central vertical axis. The upper propulsion pin 296 and the lower propulsion pin 298 are mounted on the fixed vertical plate 132, and are respectively spaced along a second vertical axis equidistantly above and below the horizontal mid-line between the upper stop pin 294 and the lower stop pin 300. The nozzle rotating cam 286 is mounted on hollow shaft 140, which is rotatably mounted on the movable plate 136. The nozzle rotating cam 286 has three radial grooves in the circumference thereof. The first radial groove 288 operatively engages the upper stop pin 294 when the movable plate 136 is in the upward position 153, so as to orient the nozzle rotating cam 286 in an upward angular position, as shown in FIGS. *6a, 6d* and *15a*. The second radial groove 290 operatively engages the upper propulsion pin 296 when the movable plate 136 is moved toward the downward position 155. This downward motion is imparted by the push rod 160. The engagement of the upper propulsion pin 296 with the radial groove 290 orients the nozzle rotating cam 286 in a horizontal angular position, as shown in FIGS. *6b, 6e* and *15b*. The third groove 292 operatively engages the lower propulsion pin 298 when the movable plate 136 is moved further downward toward the downward position 155. This orients the nozzle rotating cam 286 in a downward angular position where the first groove 288 operatively engages the lower stop pin 300, as shown in FIGS. *6c, 6f* and *15c*.

The vacuum picking nozzle 40 is mounted on the hollow shaft 140 in FIG. *6g* so as to rotate with the cam 286 so that when the movable plate 136 is in the upward position 153, the vacuum port 152 for the nozzle 40 is facing upwardly as shown in FIG. *6d*, contacting a first cover *36a* of the plurality of covers 36 in the cover storage portion 38. The vacuum picking nozzle 40 is connected through the hollow shaft 140 and the connecting block 148 to the flexible vacuum tube 150, so that a vacuum is applied at the nozzle vacuum port 152 to the cover *36a* exposed through the hole 158 in the cover storage portion 38. The vacuum picking nozzle 40 then adheres to the first cover *36a* by operation of the vacuum and the cover *36a* is withdrawn through the hole 158, in contact with the vacuum port 152, as the movable plate 136 slides downward from the upward position 153, as is shown in FIGS. *6b* and *6e*. The slot 154 in the vertical plate 132 allows the hollow shaft 140, which projects therethrough, to freely move in the vertical direction. The flexible vacuum tube 150 is shown in an uncoiled condition in FIG. *6a* when the movable plate 136 is at the upper position 153 with the vacuum nozzle 40 facing upward. The flexibility of the vacuum tube 150 allows it to coil up as shown in FIG. *6c* when the movable plate 136 moves downward to 155 and the nozzle 40 faces down. This feature greatly simplifies the structure of the cover dispenser 16.

Figure 6A:
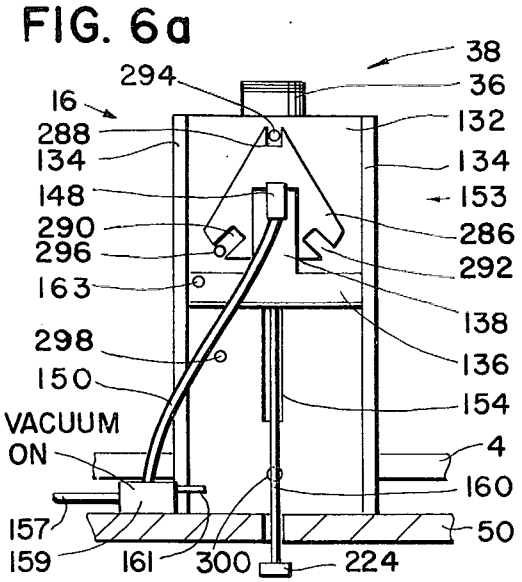
Figure 6B:
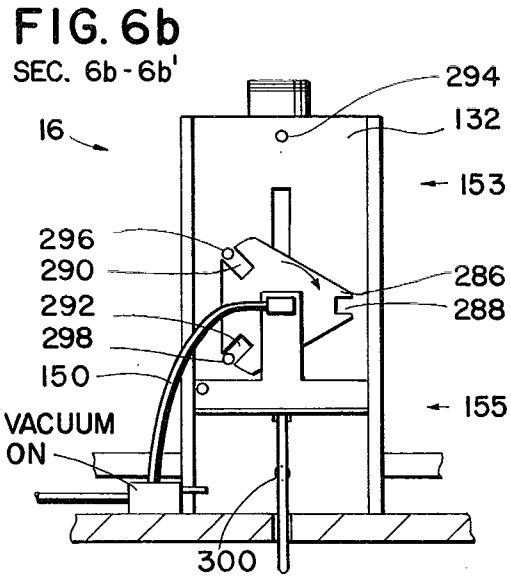
Figure 6C:
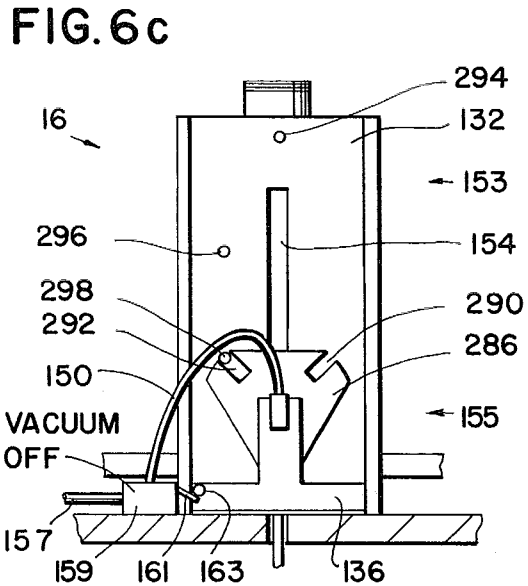
Figure 6D:
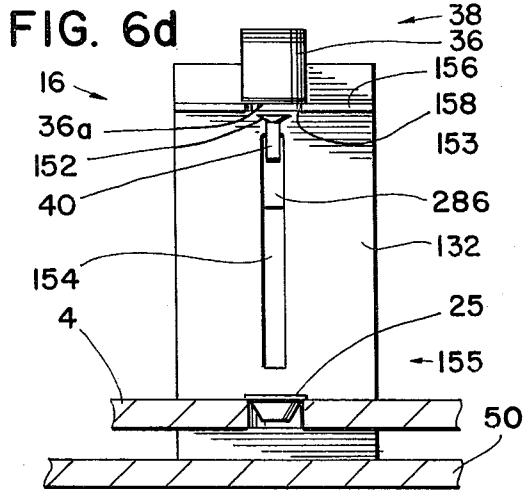
Figure 6E:
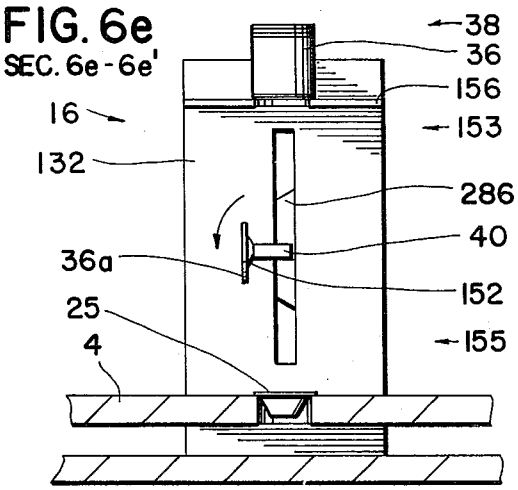
Figure 6F:
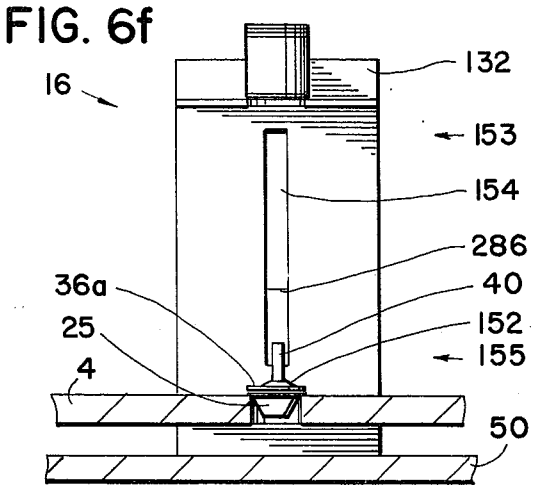

The vacuum picking nozzle 40 then faces downward as is shown in FIG. 6*f*, positioning the cover 36*a* onto one of the cups 25 in one of the table holes 10 aligned with the cover dispenser 16, when the movable plate 136 reaches the downward position 155 in response to the cam 90 being oriented in the actuating orientation 91.

A vacuum valve 159 is mounted to the fixed plate 132 proximate to the movable plate 136 when the movable plate is in the downward position 155. The vacuum valve 159 has an inlet port connected to a vacuum source 157, an outlet port connected by means of the hose 150, the vacuum block 148 and the hollow shaft 140 to the vacuum picking nozzle 40, and an operating lever 161. A pin 163 located on the sliding plate 136 contacts the lever 161 and actuates the vacuum valve 159 when the movable plate 136 is in its downward position 155. This action interrupts the conduction of the vacuum from the inlet port 157 to the outlet port 150. The operating lever 161 of the vacuum valve 150 is actuated as is shown in FIG. 6*c* by contact with the pin 163 on the movable plate 136 when it is in the downward position 155, so as to interrupt the application of vacuum to the vacuum nozzle 40 and thereby release the cover 36*a* from the vacuum port 152 onto the cup 25.

The heat sealing station 18, shown in detail in FIGS. 7*a* and 7*b*, includes the rotary cam 88 which is operatively connected by means of the shaft 276 of FIG. 5 to the motor 52. The rotary cam 88 rotates at a constant angular velocity having a period T, and has an actuating orientation 147 which is timed to occur during the rest period TR for the table 4.

An arm 135 is operatively connected by means of the push rod 137, to follower alignment block 280, tension spring 284 and cam follower 278 of FIG. 5 to the rotary cam 88. The arm 135 has the heating element 42 mounted on springs 42' on the underside thereof over the table 4. The arm 135 moves the heating element 42 from an upward position to a lower position where it contacts the cover 36*a*, compresses the springs 42' and heats the cover 36*a* placed over the mouth of the cup 25 in one of the table holes 10 aligned with the heat sealing station 18, when the cam 88 is oriented in the actuating orientation 147.

The cups 25 are typically made from thermoformed thermoplastics such as polyethylene or polystyrene and the covers 36 are typically made from aluminum foil having a coating of a thermoplastic material such as polyethylene or polystyrene on the underside thereof. When the heating element 42 is brought into contact with the cover 36*a* which has been placed on top of the cup 25, the thermoplastic materials on the respective surfaces are fused together forming an hermetic seal for the cup.

The rotary cam 88 shown in FIG. 7*b* is a cylindrical body mounted on drive shaft 276 coincident with a rotary axis z, having reference axis x perpendicular to the rotary axis z. The rotary cam 88 has a first cam surface 145 on the cylindrical circumference of the body having a radius of curvature of approximately 1.562 units and a center of curvature displaced approximately 0.500 units along a first end of the reference axis x from the rotary axis z and subtending an angle in a first direction from a second end of the reference axis x of approximately 150° with respect to the rotary axis z.

The rotary cam 88 has a second cam surface 149 on the cylindrical circumference of the body having a radius of curvature of approximately 2.094 units and a center of curvature displaced approximately 1.000 units along the first end of the reference axis x from the rotary axis z and subtending an angle in a second direction from the second end of the reference axis x, opposite to the first direction, of approximately 100° with respect to the rotary axis z.

The rotary cam 88 has a third cam surface 147 on the cylindrical circumference of the body having a radius of curvature of approximately 2.000 units and a center of curvature coincident with the rotary axis z and subtending an angle of approximately 110° with respect to the rotary axis z.

The cam follower 278 connected to shaft 137, which moves the arm 135, contacts the cylindrical circumference of the cam body 88 at a point along the second end of the reference axis x, as shown in FIG. 7*b*. The first cam surface 145 imparts a slow descent of the heating element 42 from the upward position to contact the cover 36*a*. The third cam surface 147 imparts a controlled pressure and duration of contact of the heating element 42 with the cover 36*a* to heat seal the cover 36*a* to the cup 25. The second cam surface 149 imparts a rapid upward withdrawal of the heating element 42 from the heat sealed cover 36*a*.

The removal station 20 shown in FIG. 1 includes the rotary cam 86 shown in FIG. 11 which is operatively connected by means of the shaft 214 to the motor 52. The rotary cam 86 rotates at a constant angular velocity having a period T. The rotary cam 86 has an actuating orientation which is timed to occur during the rest period TR for the table 4. The elevator 22 includes a platform 170 which is operatively connected by means of the lever 220 of FIG. 11 to the rotary cam 86. The platform 170 has a horizontal dimension which is less than the diameter of the holes 10 in the table 4, so that the platform 170 may move upward from a lower position below the table 4 to contact and elevate the cup 25 in one of the table holes 10 aligned with the platform 170. FIG. 8 shows the phantom outline of the platform 170 in its raised position 170' with the cam 86 in its actuating position with lever 22 of FIG. 11 upward. The cup 25 is raised up to the level of the removal ramp 172 when the lever 220 and cam 86 is oriented in the actuating orientation 87.

The rake 24 of FIG. 1, includes a rotary actuator 238 of FIG. 11 which is operatively connected by means of the shaft 208 to the motor 52. The rotary actuator 238 rotates at a constant angular velocity having a period T. The rotary actuator 238 has a cam follower 236 which is timed to push lever 240 during the rest period TR for the table 4.

The rake 24 has an arm 178 shown in FIG. 9*a* which is connected to pivot shaft 174. The rake 24 has an arm 178 shown in FIGS. 9*a* and 9*b* which is connected to pivot shaft 174. Push lever 240 is connected to pivot shaft 174 and therefore rake 24 is actuated in synchronism with the period TR of FIG. 10. Spring 242 forces pivot shaft 174 back to its rest position. The arm 178 extends over the table 4 and is proximate to the elevator platform 170. The arm 178 moves horizontally over the hole 10 in the table 4 aligned with the platform 170, after the platform 170' has elevated the cup 25. At this point, the rake 178 contacts and horizontally moves the elevated cup 25 so that it moves off the platform 170' and onto the removal ramp 172, when the second cam 84 is oriented in the actuating orientation 85. The timing diagram for the relative operation of the elevator and rake is shown in FIG. 10. The relative height of the arm 178 above the table 4 can be adjusted for the particular shape of the cup 25 being conveyed.

The resulting automatic container filling apparatus automatically fills and caps the cups 25 in a more efficient and sanitary manner than was available in the prior art.

Although specific embodiments of the invention have been disclosed, changes may be made in minor details of the structures without departing from the spirit and the scope of the invention.

What is claimed is:

1. An automatic container filling apparatus, comprising:

a circular table rotatably mounted on a base member for rotation about an axis perpendicular to said base member, having a plurality of holes therethrough spaced at equal angles about the circumference of the table;

drive means mounted to said base member and operatively connected to said table for periodically rotating said table through said angle;

a cup dispenser mounted on said base member at a first position over said table, having a plurality of cups stored in a storage portion and a cup delivery mechanism adjacent to said cup storage portion, which operatively is connected to said drive means, for periodically dispensing one of said plurality of cups into each of said holes in said table in synchronism with said periodic table rotation;

a filling station mounted on said base member at a second position over said table, having a fluid reservoir storing a fluid to be dispersed into said cups and a fluid delivery mechanism connected to said reservoir, which is operatively connected to said drive means, for periodically dispensing a predetermined volume of said fluid through a delivery nozzle connected therewith, into each of said cups in said holes in said table in synchronism with said periodic table rotation;

a cover dispenser mounted on said base member at a third position over said table, having a plurality of cup covers stored in a cover storage portion and a vacuum picking nozzle adjacent to said cover storage portion which is operatively connected to said drive means, for periodically picking one of said plurality of covers and placing it over the mouth of each one of said cups filled with said fluid in said holes in said table in synchronism with said periodic table rotation;

a heat sealing station mounted on said base member at a fourth position over said table, having a heating element which is operatively connected to said drive means, for periodically heating said cover placed over the mouth of each one of said cups filled with said fluid in said holes in said table to heat-seal said cover to said cup in synchronism with said periodic table rotation;

a cup removal station, including a removal ramp, mounted on said base member at a fifth position adjacent to said table;

said drive means further comprising:

a motor for providing rotary power;

a Geneva driving wheel operatively connected to said motor and rotating at a constant angular velocity;

a Geneva indexing wheel having a plurality of n radial grooves in the circumference thereof equal in number to said plurality of holes in said table, for periodically rotating said table, between rest periods, through an angle of 360/n degrees;

said cover dispenser further comprising:

a rotary cam operatively connected to said motor and rotating at said constant angular velocity, having an actuating orientation timed to occur during said rest period for said table;

a fixed vertical plate mounted on said base and located beneath said cover storage portion;

a movable plate slidably mounted to said fixed plate to assume upward and downward positions and operatively connected to said rotary cam, for undergoing vertical motion from said upward position to said downward position and then back to said upward position when said cam moves through said actuating orientation;

an upper stop pin and a lower stop pin mounted on said fixed vertical plate, along said central axis;

an upper propulsion pin and a lower propulsion pin mounted on said fixed vertical plate, respectively spaced along a second vertical axis equidistant above and below the horizontal mid-line between said upper and lower stop pins;

a nozzle rotating cam rotatably mounted on said movable plate, having three radial grooves in the circumference thereof, the first said groove operatively engaging said upper stop pin when said movable plate is in said upward position to orient said nozzle rotating cam in an upward angular position, the second said groove operatively engaging said upper propulsion pin when said movable plate is moved toward said downward position to orient said nozzle rotating cam in a horizontal angular position, the third said groove operatively engaging said lower propulsion pin when said movable plate is moved further toward said downward position to orient said nozzle rotating cam in a downward angular position where said first groove operatively engages said lower stop pin;

said vacuum picking nozzle being mounted to said nozzle rotating cam, facing upward and contacting a first one of said plurality of covers in said cover storage portion when said nozzle rotating cam is in said upward angular position;

said vacuum picking nozzle adhering to said first cover by vacuum operation and withdrawing said first cover from said cover storage portion as said movable plate slides downward from said upward position;

said vacuum picking nozzle facing downward and positioning said cover onto one of said cups in one of said table holes aligned with said cover dispenser when said movable plate reaches said downward position in response to said cam being oriented in said actuating orientation.

2. The apparatus of claim 1, wherein said cover dispenser further comprises:

a vacuum valve proximate to said movable plate when in said downward position, having an inlet port connected to a vacuum source, an outlet port connected to said vacuum picking nozzle, and an operating lever for selectively interrupting the conduction of the vacuum from said inlet port to said outlet port;

said operating lever of said vacuum valve being actuated by contact with said movable plate when in said downward position, to interrupt the application of vacuum to said vacuum nozzle and thereby release said cover from said vacuum picking nozzle to said cup.

3. An automatic container filling apparatus, comprising:

a circular table rotatably mounted on a base member for rotation about an axis perpendicular to said base member, having a plurality of holes therethrough spaced at equal angles about the circumference of the table;

drive means mounted to said base member and operatively connected to said table for periodically rotating said table through said angle;

a cup dispenser mounted on said base member at a first position over said table, having a plurality of cups stored in a storage portion and a cup delivery mechanism adjacent to said cup storage portion, which operatively is connected to said drive means, for periodically dispensing one of said plurality of cups into each of said holes in said table in synchronism with said periodic table rotation;

a cover dispenser mounted on said base member at a third position over said table, having a plurality of cup covers stored in a cover storage portion and a vacuum picking nozzle adjacent to said cover storage portion which is operatively connected to said drive means, for periodically picking one of said plurality of covers and placing it over the mouth of each one of said cups filled with said fluid in said holes in said table in synchronism with said periodic table rotation;

a heat sealing station mounted on said base member at a fourth position over said table, having a heating element which is operatively connected to said drive means, for periodically heating said cover placed over the mouth of each one of said cups filled with said fluid in said holes in said table to heat-seal said cover to said cup in synchronism with said periodic table rotation;

a cup removal station, including a removal ramp, mounted on said base member at a fifth position adjacent to said table;

said drive means further comprising:

a motor for providing rotary power;

a Geneva driving sheel operatively connected to said motor and rotating at a constant angular velocity;

a Geneva indexing wheel having a plurality of n radial grooves in the circumference thereof equal in number to said plurality of holes in said table, for periodically rotating said table, between rest periods, through an angle of 360/n degrees;

said heat sealing station further comprising:

a rotary cam operatively connected to said motor and rotating at said constant angular velocity, having an actuating orientation timed to occur during said rest period for said table;

an arm operatively connected to said rotary cam, having said heating element mounted on the underside thereof over said table, for moving said heating element from an upward position to a lower position where it contacts and heats said cover placed over the mouth of said cup in one of said table holes aligned with said heat sealing station when said cam is oriented in said actuating orientation;

said rotary cam further comprising:

a cylindrical body mounted on a drive shaft coincident with a rotary axis, having a reference axis perpendicular to said rotary axis;

a first cam surface on the cylindrical circumference of said body having a radius of curvature of approximately 1.562 units and a center of curvature displaced approximately 0.500 units along a first end of said reference axis from said rotary axis and subtending an angle in a first direction from a second end of said reference axis of approximately 150° with respect to said rotary axis;

a second cam surface on the cylindrical circumference of said body having a radius of curvature of approximately 2.094 units and a center of curvature displaced approximately 1.000 units along said first end of said reference axis from said rotary axis and subtending an angle in a second direction from said second end of said reference axis, opposite to said first direction, of approximately 100° with respect to said rotary axis;

a third cam surface on the cylindrical circumference of said body having a radius of curvature of approximately 2,000 units and a center of curvature coincident with said rotary axis and subtending an angle of approximately 110° with respect to said rotary axis;

said arm contacting said cylindrical circumference of said cam body at a point along said second end of said reference axis;

said first cam surface imparting a slow descent of said heating element from said upward position to contact said cover, said third cam surface imparting a controlled pressure and duration of contact of said heating element with said cover to heat-seal said cover to said cup and said second cam surface imparting a rapid upward withdrawal of said heating element from said heat-sealed cover.

4. An automatic container filling apparatus, comprising:

a circular table rotatably mounted on a base member for rotation about an axis perpendicular to said base member, having a plurality of holes therethrough spaced at equal angles about the circumference of the table;

drive means mounted to said base member and operatively connected to said table for periodically rotating said table through said angle;

a cup dispenser mounted on said base member at a first position over said table, having a plurality of cups stored in a storage portion and a cup delivery mechanism adjacent to said cup storage portion, which operatively is connected to said drive means, for periodically dispensing one of said plurality of cups into each of said holes in said table in synchronism with said periodic table rotation;

a filling station mounted on said base member at a second position over said table, having a fluid reservoir storing a fluid to be dispensed into said cups and a fluid delivery mechanism connected to said reservoir, which is operatively connected to said drive means, for periodically dispensing a predetermined volume of said fluid through a delivery nozzle connected therewith, into each of said cups in said holes in said table in synchronism with said periodic table rotation;

a cover dispenser mounted on said base member at a third position over said table, having a plurality of cup covers stored in a cover storage portion and a vacuum picking nozzle adjacent to said cover storage portion which is operatively connected to said drive means, for periodically picking one of said plurality of covers and placing it over the mouth of each one of said cups filled with said fluid in said holes in said table in synchronism with said periodic table rotation;

a heat sealing station mounted on said base member at a fourth position over said table, having a heating element which is operatively connected to said drive means, for periodically heating said cover placed over the mouth of each one of said cups filled with said fluid in said holes in said table to heat-seal said cover to said cup in synchronism with said periodic table rotation;

a cup removal station, including a removal ramp, mounted on said base member at a fifth position adjacent to said table;

said drive means further comprising:

a motor for providing rotary power;

a Geneva driving wheel operatively connected to said motor and rotating at a constant angular velocity;

a Geneva indexing wheel having a plurality of n radial grooves in the circumference thereof equal in number to said plurality of holes in said table, for periodically rotating said table, between rest periods, through an angle of 360/n degrees;

said cover dispenser further comprising:

a rotary cam operatively connected to said motor and rotating at said constant angular velocity, having an actuating orientation timed to occur during said rest period for said table;

a fixed vertical plate mounted on said base and located beneath said cover storage portion, having a central vertical axis;

a movable plate slidably mounted to said fixed plate to assume upward and downward positions and operatively connected to said rotary cam, for undergoing vertical motion from said upward position to said downward position and then back to said upward position when said cam moves through said actuating orientation;

an upper stop pin and a lower stop pin mounted on said fixed vertical plate, along said central axis;

an upper propulsion pin and a lower propulsion pin mounted on said fixed vertical plate, respectively spaced along a second vertical axis equidistantly above and below the horizontal mid-line between said upper and lower stop pins;

a nozzle rotating cam rotatably mounted on said movable plate, having three radial grooves in the circumference thereof, the first said groove operatively engaging said upper stop pin when said movable plate is in said upward position to orient said nozzle rotating cam in an upward angular position, the second said groove operatively engaging said upper propulsion pin when said movable plate is moved toward said downward position to orient said nozzle rotating cam in a horizontal angular position, the third said groove operatively engaging said lower propulsion pin when said movable plate is moved further toward said downward position to orient said nozzle rotating cam in a downward angular position where said first groove operatively engages said lower stop pin;

said vacuum picking nozzle being mounted to said nozzle rotating cam, facing upward and contacting a first one of said plurality of covers in said cover storage portion when said nozzle rotating cam is in said upward angular position;

said vacuum picking nozzle adhering to said first cover by vacuum operation and withdrawing said first cover from said cover storage portion as said movable plate slides downward from said upward position;

said vacuum picking nozzle facing downward and positioning said cover onto one of said cups in one of said table holes aligned with said cover dispenser when said movable plate reaches said downward position in response to said cam being oriented in said actuating orientation.

5. The apparatus of claim 4, wherein said cover dispenser further comprises:

a vacuum valve proximate to said movable plate when in said downward position, having an inlet port connected to a vacuum source, an outlet port connected to said vacuum picking nozzle, and an operating lever for selectively interrupting the conduction of the vacuum from said inlet port to said outlet port;

said operating lever of said vacuum valve being actuated by contact with said movable plate when in said downward position, to interrupt the application of vacuum to said vacuum nozzle and thereby release said cover from said vacuum picking nozzle to said cup.

6. The apparatus of claim 5, which further comprises:

a flexible vacuum tube connecting said vacuum valve outlet port to said vacuum picking nozzle, for delivering the vacuum to said nozzle;

whereby a simplified structure is obtained.

* * * * *